US007902947B2

(12) United States Patent
Lefebvre

(10) Patent No.: US 7,902,947 B2
(45) Date of Patent: Mar. 8, 2011

(54) ELECTROMAGNETIC CONTACTOR

(75) Inventor: Bruno Lefebvre, Saint Genis Laval (FR)

(73) Assignee: ABB France (FR)

( * ) Notice: Subject to any disclaimer, the term of this patent is extended or adjusted under 35 U.S.C. 154(b) by 159 days.

(21) Appl. No.: 12/298,211

(22) PCT Filed: Apr. 16, 2007

(86) PCT No.: PCT/FR2007/000637

§ 371 (c)(1),
(2), (4) Date: Mar. 27, 2009

(87) PCT Pub. No.: WO2007/128892

PCT Pub. Date: Nov. 15, 2007

(65) Prior Publication Data

US 2009/0219119 A1 Sep. 3, 2009

(30) Foreign Application Priority Data

May 9, 2006 (FR) ..... 06 04083

(51) Int. Cl.
*H01H 67/02* (2006.01)

(52) U.S. Cl. ..... 335/132; 335/131; 335/278

(58) Field of Classification Search ..... 335/126, 335/131, 132, 278, 299
See application file for complete search history.

(56) References Cited

U.S. PATENT DOCUMENTS

| | | | | |
|---|---|---|---|---|
| 4,739,293 | A | 4/1988 | Hurley et al. | |
| 4,893,102 | A * | 1/1990 | Bauer | 335/132 |
| 5,703,551 | A * | 12/1997 | Lefebvre et al. | 335/126 |
| 5,936,497 | A * | 8/1999 | Vilou | 335/126 |
| 6,049,263 | A * | 4/2000 | Vilou | 335/126 |
| 6,229,415 | B1 * | 5/2001 | Quentric | 335/131 |

FOREIGN PATENT DOCUMENTS

| | | |
|---|---|---|
| EP | 0411397 | 2/1991 |
| EP | 0751545 | 1/1997 |

OTHER PUBLICATIONS

International Search report PCT/FR2007/000637/; Dated Sep. 9, 2007.

* cited by examiner

*Primary Examiner* — Ramon M Barrera
(74) *Attorney, Agent, or Firm* — Cantor Colburn LLP

(57) ABSTRACT

Electromagnetic contactor comprising a winding (6) for generating a magnetic field, a magnetic circuit comprising a stationary portion (7) and a mobile portion (8), and an electronic board (11) comprising means of controlling the power supply to the winding (6), the electronic board (11) being arranged horizontally above the stationary portion (7) of the magnetic circuit. The mobile portion (8) passes through the electronic board (11) via an opening (12) in the board and slides into the winding, the contactor comprising an insulating casing including a rear portion intended to be fastened onto a support.

13 Claims, 6 Drawing Sheets

ELECTROMAGNETIC CONTACTOR

TECHNICAL FIELD OF THE INVENTION

The invention relates to an electromagnetic contactor. In particular, the invention relates to an electromagnetic contactor intended to be fastened to a support rail, in contact with other electrical appliances.

BRIEF SUMMARY OF THE INVENTION

As is known, an electromagnetic contactor comprises:

a coil for generating a magnetic field; and a magnetic circuit having a fixed part and a moving part.

Elastic means are provided for keeping the fixed and moving parts apart in the absence of power supplied to the coil.

In general, the electrical operation of a contactor may be described in two separate phases.

During a first, inrush phase, when the coil is supplied with current, the magnetic circuit tends to be closed, the moving part moving toward the fixed part until these two parts are in contact. During this phase, a large amount of power is needed so as to overcome the initial gap and to move the moving part against the action of the elastic means. This power, called inrush power, is determined by the number of ampere-turns of the coil, i.e. the number of turns of the coil multiplied by the intensity of the current in the coil.

During a second, hold phase, the magnetic circuit must remain in the closed position as long as the coil is supplied with power. In the second phase, the ampere-turns needed is much lower than in the inrush phase, since the gap is zero, and the magnetic forces are the maximum.

In general, the contactors may be supplied with DC current or with AC current.

Specific electromagnetic technologies for reducing the necessary power, and therefore the consumption, of the contactor during the inrush and/or hold phases, have existed for many years. It is known in particular to use, for a DC drive contactor, circuits with AC drive contactor laminations provided with a coil consisting of two windings, or solid circuits that may or may not be equipped with permanent magnets. The use of these technologies usually results in an increase in the size of these contactors compared with the AC drive version.

It is also known, in particular from document EP 0 789 378, to equip an AC laminated-circuit contactor with an electronic card for controlling the power supplied to the coil.

This card is used in particular to supply the coil with DC current, whether the supply voltage is AC or DC. The card also makes it possible to increase the supply voltage range that can be used by the contactor. The card furthermore makes it possible to reduce the shocks during the inrush phase and the power consumed in the hold phase. Owing to the additional cost of the electronic card, this solution is reserved for apparatus of medium and high current rating, greater than 50 A.

It is also known to use a laminated magnetic circuit with an electronic card placed laterally in the case of the contactor relative to the coil, and perpendicular to the fitting plane, so as in particular to limit the consumption at inrush and make it compatible with controller outputs.

However, it turns out that this solution imposes a specific and limiting arrangement of the supply terminals of the card, thereby again resulting in an increase in the size of the apparatus when this solution is applied on various current ratings of contactors.

For all contactors, it is desirable to meet the following criteria:

- low consumption at inrush, if possible compatible with controller outputs;
- low consumption during the hold phase;
- capability of accepting wide DC or AC supply voltage ranges;
- same size as that of an AC apparatus of equivalent current rating; and
- production cost the same as that of a conventional AC apparatus.

However, it is difficult to reconcile all these criteria.

Document EP 0 751 545 discloses an electromagnetic contactor comprising:

- a coil for generating a magnetic field;
- a magnetic circuit comprising a fixed part and a moving part; and
- an electronic card comprising means for controlling the power supplied to the coil, the electronic card being placed horizontally on top of the fixed part of the magnetic circuit.

However, this contactor is intended for an automobile application in which it is possible for the contactor to have a large dimension along the axis of displacement of the moving part of the armature. Consequently, this contactor has a moving armature that passes through the fixed armature and extends toward the rear of the contactor relative to the coil.

Such an arrangement cannot be envisioned for a contactor intended to be positioned on a support rail by fastening means placed to the rear of the coil.

BRIEF SUMMARY OF THE INVENTION to the invention provides a contactor intended to be fastened to a support, the size of which is small.

The invention further provides a contactor that better meets the above criteria.

For this purpose, the subject of the present invention is an electromagnetic contactor of the aforementioned type, characterized in that the contactor comprises an insulating case that includes a rear part intended to be fastened to a support and in that the moving part passes through the electronic card via an opening in the card and slides inside the coil.

The provisions according to the invention allow the size of the contactor to be reduced.

Such a contactor also makes it possible to benefit from the abovementioned advantages of having an electronic card.

Preferably, the contactor comprises terminals for connecting the coil, these being located in the plane of the electronic card.

This arrangement of the connection terminals makes it possible, on the one hand, to retain the connections for supplying power to the contactor that are made in the same way as a conventional contactor, that is to say above the coil, and, on the other hand, to further limit the size of the contactor.

According to one embodiment, the fixed and moving parts of the magnetic circuit have approximately axisymmetric shapes.

The axisymmetric structure of the magnetic components provides better efficiency than a conventional plane structure.

Advantageously, the fixed and moving parts have conical portions facing each other, one being convex and the other concave.

The electronic card makes it possible to limit the shocks during the inrush phase, and therefore to considerably reduce the contact areas of the two armatures without exposing the magnetic circuit to premature wear, and without increasing the conjunction time.

It is therefore possible to use the conical "progressive gap" shape that reduces the ampere-turns needed at inrush, since the effective gap is smaller than the actual travel of the moving core.

The combination of the above features consequently makes it possible to obtain a contactor of lower inrush power and of lower overall volume, equivalent to a contactor of the same range but not having a low inrush power.

The duration of the inrush phase with the contactor according to the invention is of the same order as that of a contactor of the same range but not having a low inrush power.

According to one embodiment, the fixed and moving parts are made from solid elements.

The solid structure of the magnetic components makes it possible to optimize the shapes and the choice of materials and to use mass-production processes, such as especially deep drawing, cold stamping, or cutting. These provisions thus allow costs and the complexity of the manufacture to be reduced.

Advantageously, the fixed part forms a housing in which the coil is accommodated.

According to one embodiment, the fixed part of the magnetic circuit includes at least one lateral opening.

The presence of an opening allows coil connection means, in particular wires or portions of conductors, to pass to the outside of the body. By producing this opening it is thus possible to limit the vertical dimension of the contactor, since the passage for the coil connection means is produced on the side wall of the body of the fixed armature, and not above the latter.

According to one embodiment, the fixed part of the magnetic circuit comprises:

a cylindrical portion;

a bottom at a first end of the cylindrical portion; and a wall having an opening for passage of the moving part at a second end of the cylindrical portion.

Advantageously, the lateral opening consists of a notch in the edge of the cylindrical portion forming the second end of the cylindrical portion.

Advantageously, the fixed part of the magnetic circuit comprises:

a body, forming the cylindrical portion and the bottom; and a cover, forming the wall having the passage opening.

This arrangement makes it possible to form the fixed part of the magnetic circuit from two simple shapes, which are easier to produce. In addition, this arrangement makes it easier to fit the coil into the fixed part of the armature. It makes production of the component easier and allows it to be mass-produced.

Advantageously, the elements of the contactor are stackable.

This arrangement makes it easier to assembly the contactor. In particular, the stacking may be carried out by a simplified automated process.

According to one embodiment, the means for controlling the power supplied to the coil are designed to supply the coil with DC current, whether the supply voltage for the contactor is AC or DC.

Advantageously, the means for controlling the power supplied to the coil comprise means for determining a current value for closing the contactor, or for keeping the contactor closed, and means for limiting the average value of the supply current for the coil to the determined value.

BRIEF DESCRIPTION OF THE DRAWINGS

In any case, the invention will be better understood from the following description, with reference to the appended schematic drawing, which shows, by way of nonlimiting example, one embodiment of a contactor according to the invention.

DETAILED DESCRIPTION OF THE INVENTION

Figure 1:
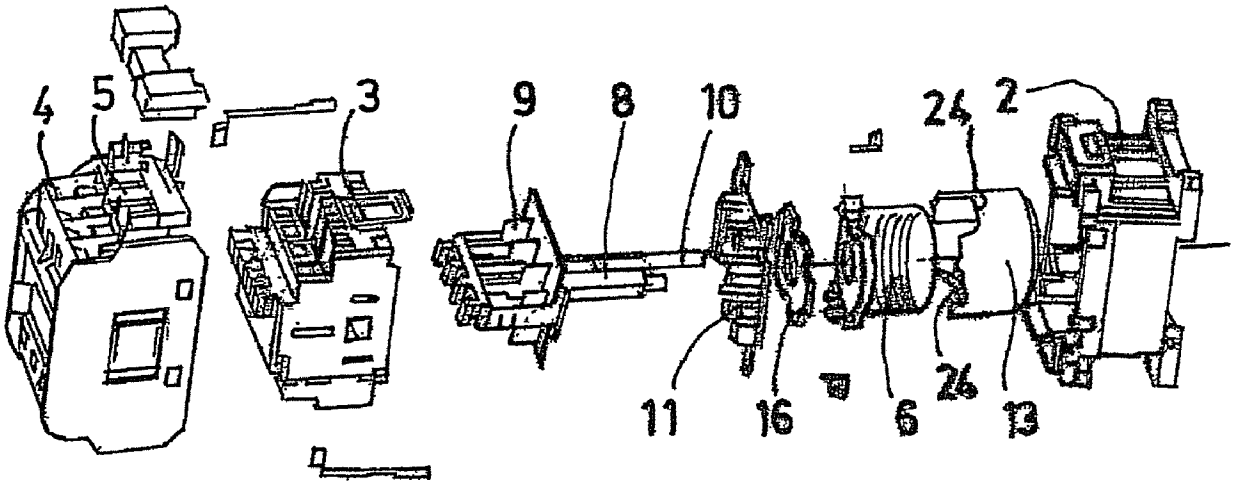
FIG. 1 is an exploded perspective view of a contactor according to the invention.
Figure 2:
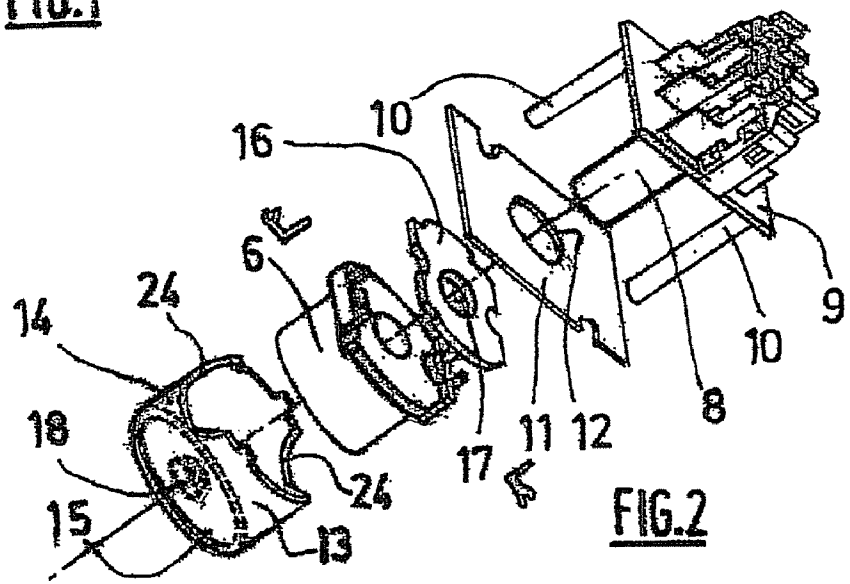
FIG. 2 is an exploded perspective view of the contactor of FIG. 1, the constituent parts of the case having been omitted.

According to one embodiment, shown in FIGS. 1 to 4, an electromagnetic contactor according to the invention comprises an insulating case having a rear part 2, intended to be fastened to a support, and a front part 3, intended to be fastened to the rear part 2. Fixed contacts (not shown) are fastened to the front part 3 of the case. The insulating case also includes a terminal block 4 intended to be fastened above the front part and comprising connection terminals 5 intended to be connected to the fixed contacts.

The parts of the case form a housing in which the following are accommodated:

a coil 6 for generating a magnetic field, said coil being fastened to the case; and a magnetic circuit having a fixed part 7 relative to the case and a moving part 8 relative to the case.

A moving-contact holder 9 is mounted so as to be fastened to the moving part 8 of the magnetic circuit.

The contact holder 9 comprises moving contacts, which are intended to be in contact with the fixed contacts, or are separate from these fixed contacts, depending on the position of the moving part 8, so as to close or open an electrical power circuit.

Elastic means, consisting of two springs 10, are provided for keeping the fixed 7 and moving 8 parts apart when the coil 6 is not supplied with power.

The contactor includes means for controlling the AC or DC voltage supply for the coil 6, these consisting of an electronic card 11.

This electronic card 11, of the type described in document EP 0 789 378, is placed at the interface between the external power supply and the power supply for the coil of the contactor. This electronic card 11 is placed horizontally above the fixed part 7 of the magnetic circuit, the moving part 8 passing through the electronic card via an opening in the card 12 and sliding inside the coil and the fixed part 7.

It should be noted that coil connection terminals of the terminal block 5 lie in the plane of the electronic card.

As shown in FIGS. 1 to 4, according to one feature of the invention, the fixed 7 and moving 8 parts of the magnetic circuit have an axisymmetric shape relative to an axis A, which coincides with the axis of the coil 6.

In particular, the fixed part 7 of the magnetic circuit comprises:

- a body 13 forming:
  - a cylindrical portion 14 and
  - a bottom 15 at a first end of the cylindrical portion 14; and
- a cover 16 forming a wall having a passage opening 17 for passage of the moving part 8, intended to be positioned at a second end of the cylindrical portion 14.

The body and the cover define a housing in which the coil 6 is accommodated. The passage opening 17, lying around the axis A, allows the moving part to penetrate into the coil 6.

The moving part 8 itself includes a cylindrical portion intended to enter the passage opening 17.

Figure 3:
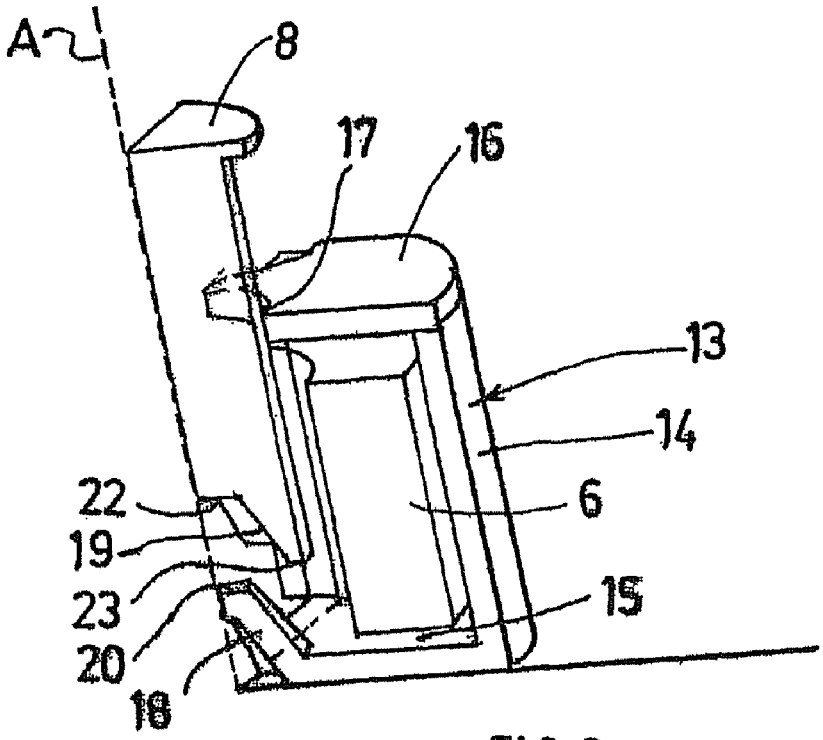
FIG. 3 is a perspective view in partial cross section of the magnetic circuit.

As illustrated in FIG. 3, the fixed 7 and moving 8 parts have facing conical portions. In particular, the fixed part has a convex conical portion 18 placed on the bottom 15 of the body 13. The moving part 8 has a concave conical portion 19. Of course, the concave portion could be positioned on the fixed part and the convex portion on the moving part.

The two conical portions 18, 19 have a shape suitable for leaving a gap between them when the two, fixed and moving, parts are in contact with each other. In particular, the plane terminal ends 20, 22 of the two conical parts do not come into contact when the fixed and moving parts are in contact with each other.

Only the edge 23 defining the concave conical part 19 of the moving part 8 butts against the bottom 15 of the body 13.

The fixed 7 and moving 8 parts are made from solid elements.

The body 13 of the fixed part 7 of the magnetic circuit includes, on its upper edge, on which the cover 16 is positioned, notches 24. These notches allow the coil connection means, in particular wires or other conductor portions, to pass to the outside of the body.

Furthermore, these notches help to improve the cooling of the coil.

Figure 6:
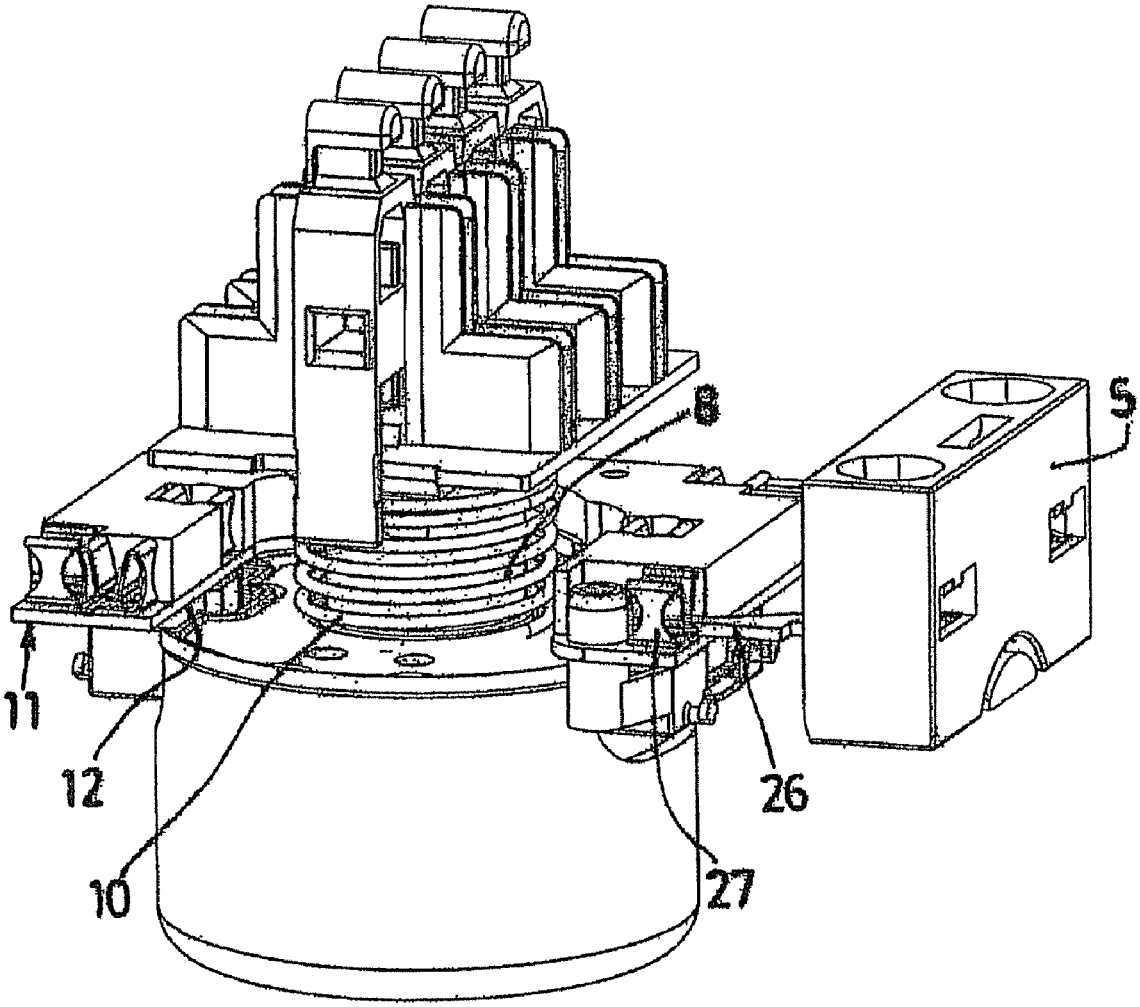
FIG. 6 is a partial perspective view of a second contactor according to the invention.
Figure 7:
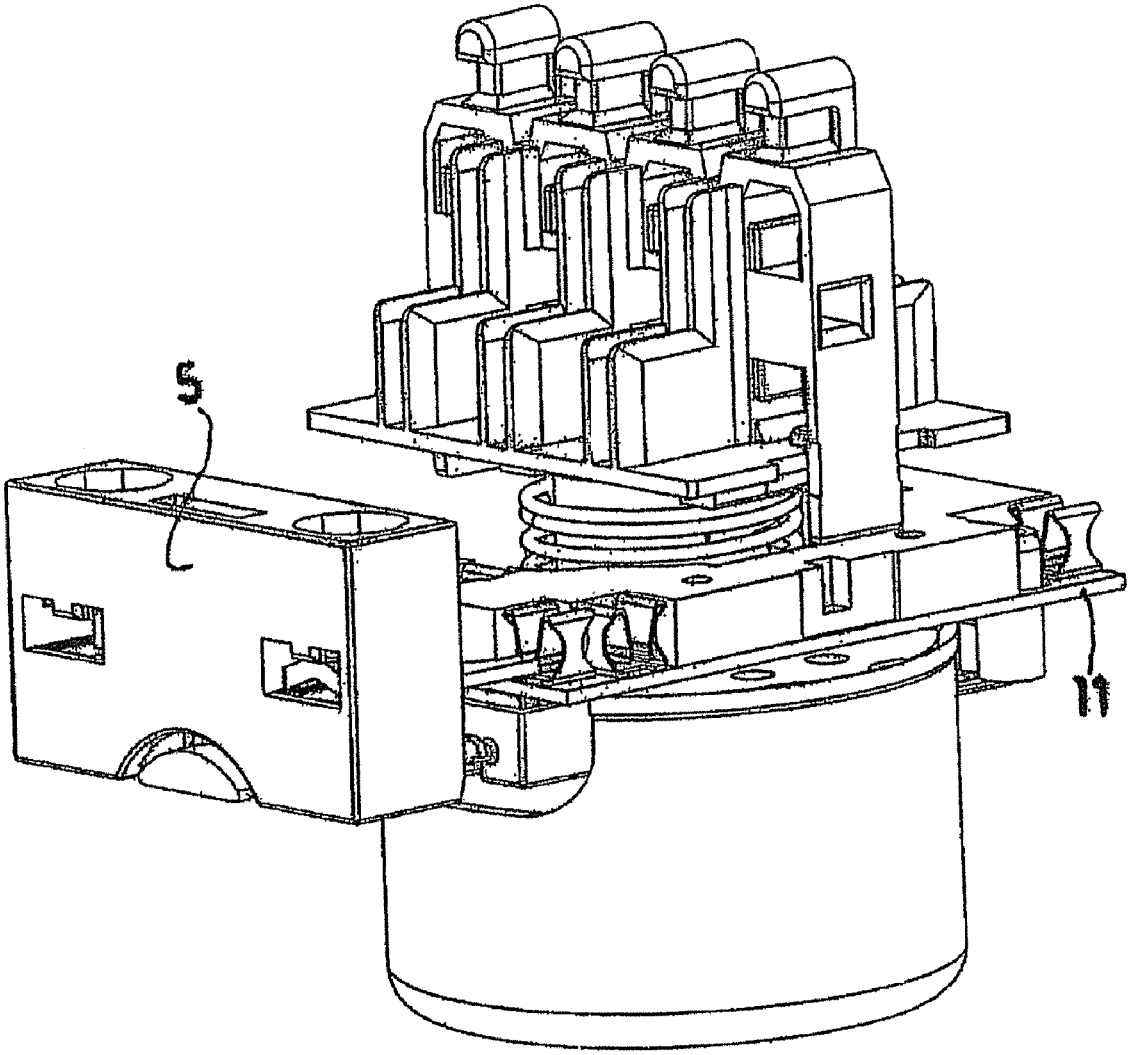
FIG. 7 is another partial perspective view at a second viewing angle of the contactor of FIG. 6.
Figure 8:
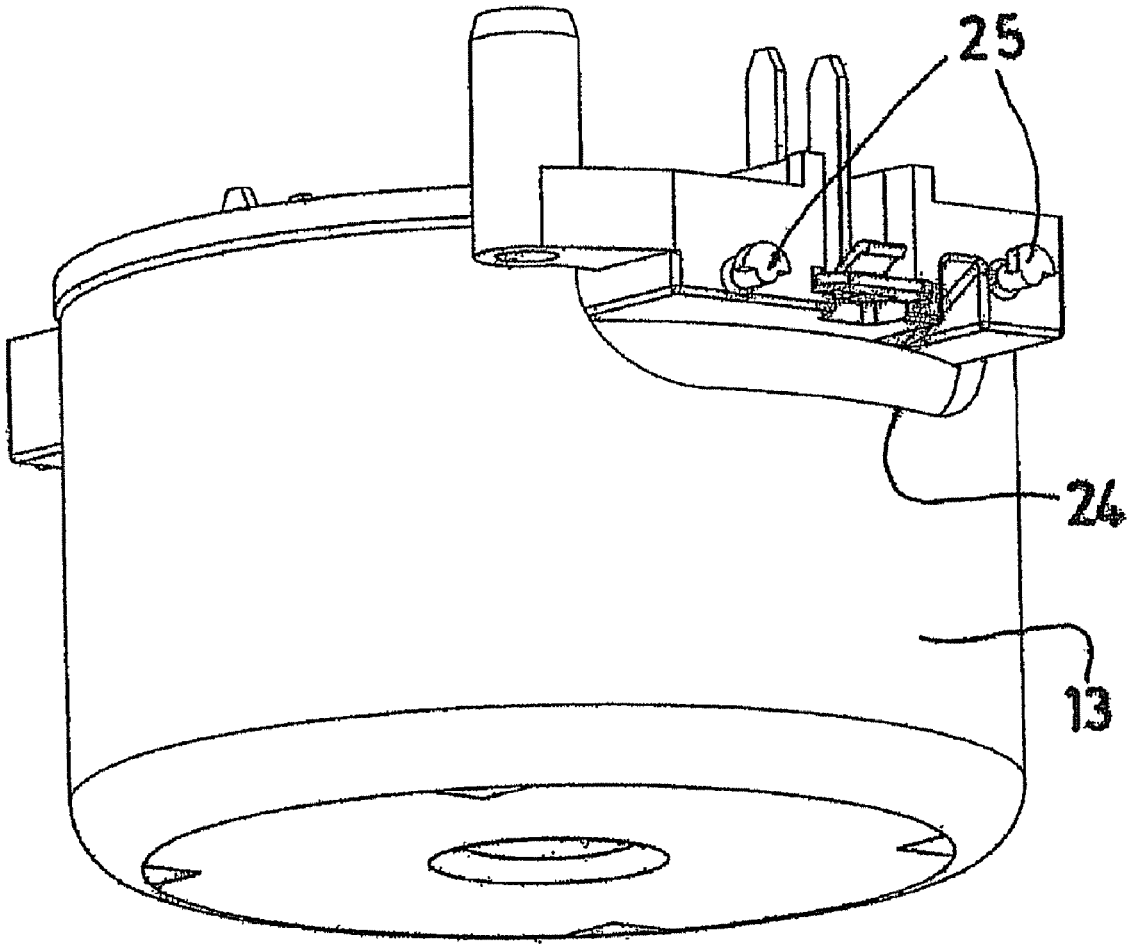
FIG. 8 is a detailed perspective view of the fixed part of the magnetic circuit of the contactor of FIG. 6.

According to a second embodiment shown in FIGS. 6 to 8, the contactor comprises substantially the same elements as in the first embodiment. However, unlike the first embodiment, a single return spring 10 is present for separating the armatures in the rest position, this spring being positioned around the moving armature. In this second embodiment, the electronic card 11 has an opening consisting of a cut-out 12 that opens onto the edge of the electronic card 11 through which the moving part 8 of the magnetic circuit crosses the plane of the electronic card. As previously, the coil connection terminals of the terminal block 5 lie in the plane of the electronic card. The terminal block 5 is a removable terminal block comprising metal tabs 26 intended to be accommodated in resilient tuning-fork contacts 27 fitted onto the card 11 for providing electrical connection.

FIG. 8 shows the construction of the notches 24 on the upper edge of the fixed part of the armature, allowing passage of the coil connection means comprising flexible wires or rigid conductor portions 25.

Figure 4:
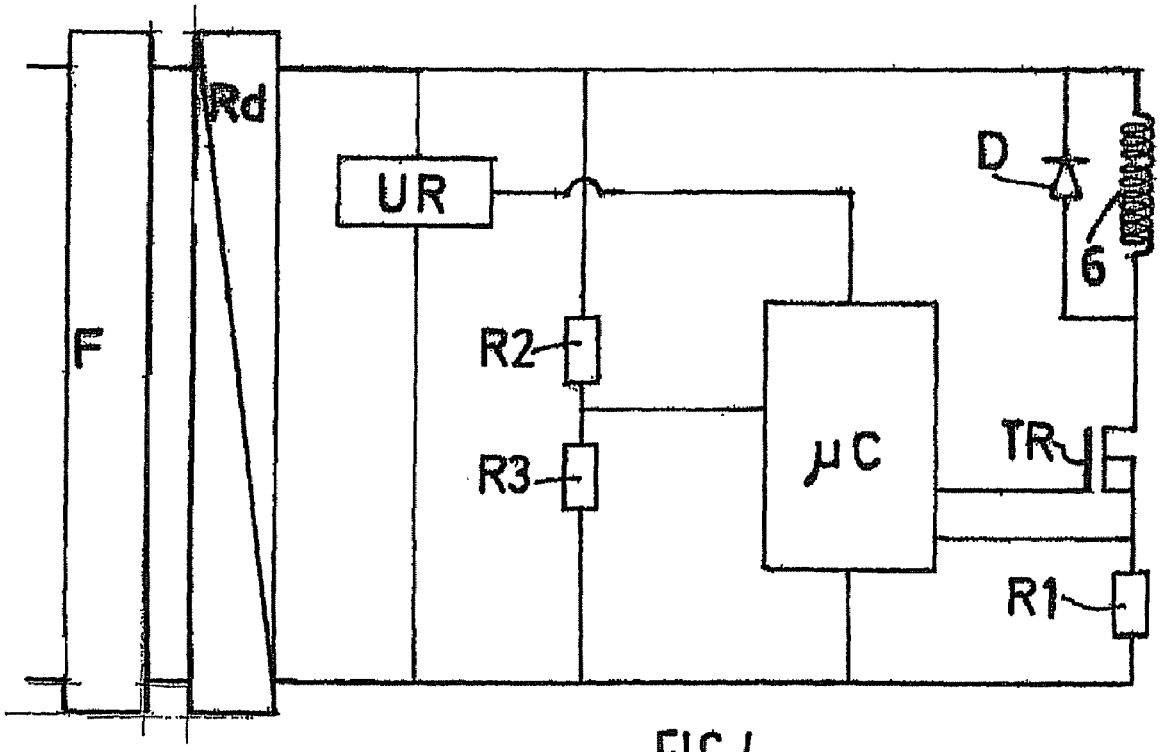
FIG. 4 is a diagram of the electrical circuit of the electronic card of the contactor of FIG. 1.

As shown in FIG. 4, the electronic card, used by both contactors described above, comprises a filter component F and a rectifier component Rd for transforming an AC voltage into a DC voltage. In particular, the rectifier component Rd may include a diode bridge.

These components allow the coil to be supplied with DC current, whether the supply voltage for the contactor is AC or DC.

The electronic card includes means for determining a current value for closing the contactor or for keeping the contactor closed, and means for limiting the average value of the supply current to the coil to the determined value.

In particular, the coil 6 of the contactor is supplied by a step-down voltage chopper consisting of a power transistor TR, whether a bipolar transistor, MOSFET or IGBT, operating in "on/off" mode, controlled by a PWM (pulse width modulation) signal generated by a control device consisting here of a microcontroller μC. This control device could also consist of any other specific logic circuit. The frequency of this signal is set and the duty cycle, that is to say the ratio of the conduction time to the period of the signal, is adjusted by the microcontroller μC.

The coil 6 is connected in series to the power transistor TR and to a resistor R1 used for measuring the current.

The microcontroller μC is supplied by a supply component UR delivering a controlled voltage.

The microcontroller μC receives, as input:

- a signal for measuring the voltage across the terminals of the resistor R1, this being a measurement of the current in the coil; and
- a signal proportional to the supply voltage for the contactor, delivered by a voltage divider formed by two resistors R2 and R3.

According to the operation of the step-down chopper, the average voltage across the terminals of the coil of the contactor is the duty cycle multiplied by the source voltage.

By adapting the duty cycle of the step-down chopper according to the input voltage level it is possible to supply the coil with a voltage of defined constant average value irrespective of the value of the contactor supply voltage. This value may be set at a minimum inrush threshold during the inrush phase and at the minimum hold threshold during the hold phase.

According to one embodiment, during the inrush phase, the 100% maximum duty cycle is reached for the minimum value of the supply voltage within the operating range of the contactor. In the hold phase, the duty cycle is automatically adjusted according to the current to be controlled.

The coil is also antiparallel-connected to a freewheeling diode D.

The freewheeling diode makes it possible to maintain the magnetic energy stored in the coil and limits the overvoltages caused by cutting off the contactor control. It is thus possible to keep the contactor closed in the event of brownouts or voltage dips, and for it to act as a voltage limiter. These arrangements allow deficiencies in the supply to be offset.

Figure 5:
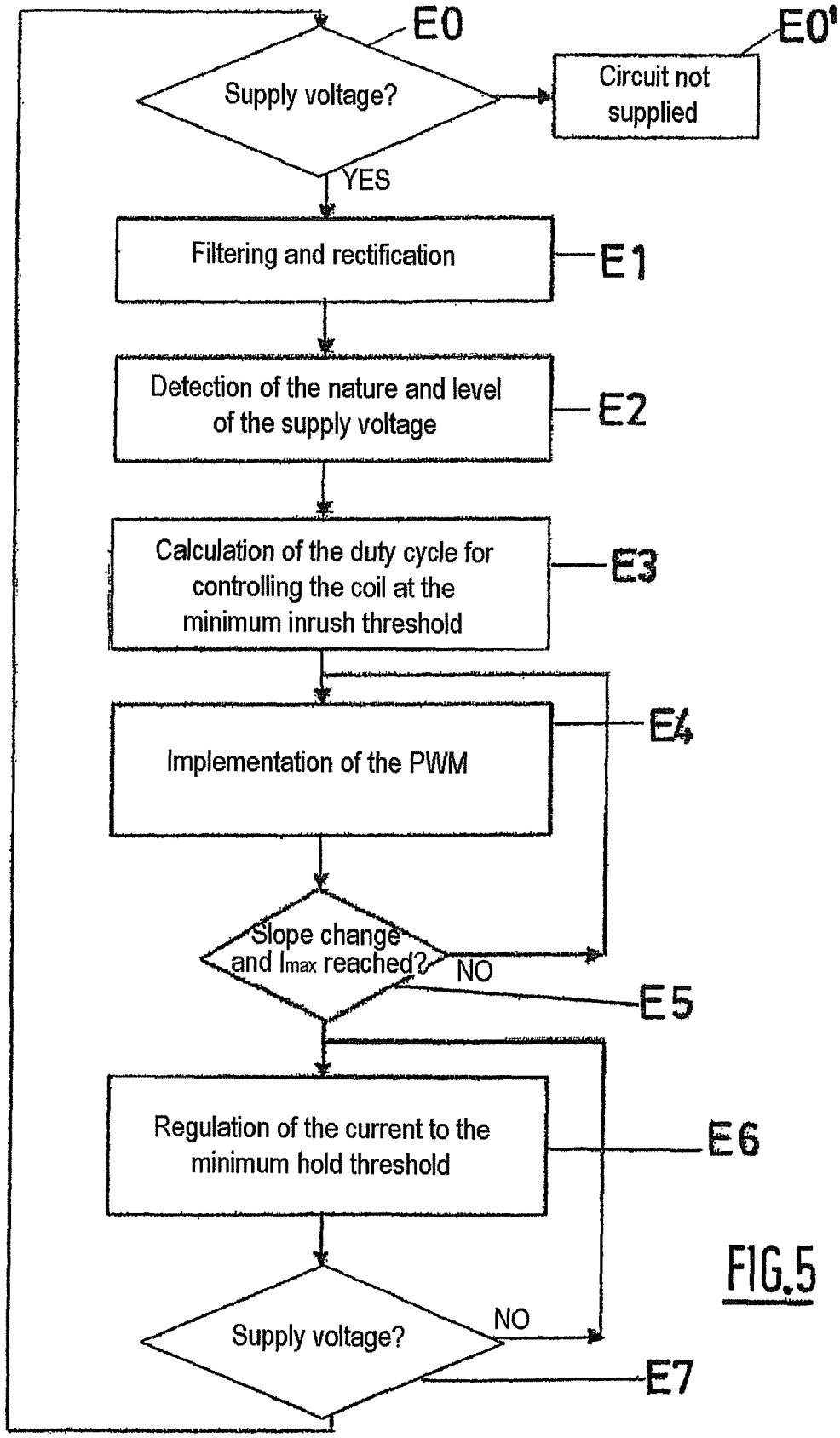
FIG. 5 is a flowchart for the operation of the control means formed by the electronic card.

FIG. 5 illustrates the operation of the card when a supply voltage is generated across the terminals of the contactor.

If no voltage is generated, the card is not supplied, this being shown in steps E0 and E0'.

If a supply voltage is generated, this is filtered by the filter component 12 and then rectified by the rectifier component 13 in a first step E1.

In a second step E2, the nature and the level of the supply voltage are detected.

In a third step E3, the minimum inrush threshold is calculated. The minimum inrush threshold is the minimum voltage level across the terminals of the coil 6 sufficient to cause breaking and closure of the magnetic circuit. With this voltage level, dynamics governing the travel of the moving contacts is sufficient to close the electrical power circuit under the correct conditions defined by standardizing constraints.

In a fourth step E4, a PWM signal is generated for controlling the supply to the coil at the minimum inrush threshold.

In a fifth step E5, a test is carried out to identify whether there is a change in slope and whether the maximum current in the coil is reached. If this is not the case, the procedure remains at step E4.

If the test is positive, the current is regulated to the minimum hold threshold in a sixth step E6. The minimum hold threshold is the current level just sufficient to keep the electromagnet closed, taking into account the mounting positions of the contactor, its capability of withstanding shocks and vibrations, and the number of associated auxiliary contacts, that is to say mechanical loads.

This regulation is carried out until a control signal for blocking the contactor is received, that is to say until the voltage passes below the minimum supply voltage for the contactor, this being shown by step E7.

The control logic controls the voltage and the current during the inrush phase, thereby making it possible to reduce shocks on and the wear of the mechanical components, and controls the current during the hold phase of the contactor. This has the advantage of reducing the power dissipated.

The electronic card 11 allows the contactor to operate over a wide AC or DC supply voltage range. The ratio of the maximum voltage to the minimum voltage across the terminals of a supply voltage range is between 1.5 and 3.

It goes without saying that the invention is not limited to the preferred embodiment described above by way of nonlimiting example, rather it encompasses all variants thereof.

The invention claimed is:

1. An electromagnetic contactor comprising:

a coil for generating a magnetic field;

a magnetic circuit comprising a fixed part and a moving part; and an electronic card comprising means for controlling the power supplied to the coil, the electronic card being placed horizontally on top of the fixed part of the magnetic circuit, wherein the contactor comprises an insulating case that includes a rear part intended to be fastened to a support and the moving part passes through the electronic card via an opening in the card and slides inside the coil.

2. The contact or as claimed in claim 1, comprising terminals for connecting the coil (6) located in the plane of the electronic card.

3. The contactor as claimed in claim 1, in which the fixed and moving parts of the magnetic circuit have approximately axisymmetric shapes.

4. The contactor as claimed in claim 1, in which the fixed and moving parts have conical portions facing each other, one being convex and the other concave.

5. The contactor as claimed in claim 1, in which the fixed and moving parts are made from solid elements.

6. The contactor as claimed in claim 1, in which the fixed part forms a housing in which the coil is accommodated.

7. The contactor as claimed in claim 6, in which the lateral opening consists of a notch in the edge of the cylindrical portion forming the second end of the cylindrical portion.

8. The contactor as claimed in claim 1, in which the fixed part of the magnetic circuit includes at least one lateral opening.

9. The contactor as claimed in claim 1, in which the fixed part of the magnetic circuit comprises:

a cylindrical portion;

a bottom at a first end of the cylindrical portion; and a wall having an opening for passage of the moving part at a second end of the cylindrical portion.

10. The contactor as claimed in claim 9, in which the fixed part of the magnetic circuit comprises:

a body, forming the cylindrical portion and the bottom; and a cover, forming the wall having the passage opening.

11. The contactor as claimed in claim 1, wherein the elements of the contactor are stackable.

12. The contactor as claimed in claim 1, in which the means for controlling the power supplied to the coil are designed to supply the coil with DC current, whether the supply voltage for the contactor is AC or DC.

13. The contactor as claimed in claim 1, in which the means for controlling the power supplied to the coil comprise means for determining a current value for closing the contactor, or for keeping the contactor closed, and means for limiting the average value of the supply current for the coil to the determined value.

* * * * *